United States Patent [19]

du Preez et al.

[11] Patent Number: 4,825,771

[45] Date of Patent: May 2, 1989

[54] RAIL GUIDED JACK FOR LIFTING DERAILED ROLLING STOCK

[75] Inventors: Hercules P. du Preez; Hermanus Dippenaar, both of Alberton, South Africa

[73] Assignee: Deton Engineering (Proprietary) Limited, Alberton, South Africa

[21] Appl. No.: 8,873

[22] Filed: Jan. 29, 1987

[30] Foreign Application Priority Data

Jan. 30, 1986 [ZA] South Africa ..... 86/0690

[51] Int. Cl.[4] ..... B61F 9/00; B61K 13/00

[52] U.S. Cl. ..... 104/246; 104/273; 254/84

[58] Field of Search ..... 104/273, 264, 262, 118, 104/120, 242, 243, 245, 246, 32.1, 107, 109; 105/462, 163.1; 254/12, 14, 108, 109, 112, 84, 105

[56] References Cited

U.S. PATENT DOCUMENTS

| | | | |
|---|---|---|---|
| 393,015 | 11/1888 | Lee | 254/105 X |
| 541,002 | 6/1895 | McManus et al. | 254/84 X |
| 698,922 | 4/1902 | Ford | 254/109 |
| 1,316,879 | 9/1919 | Di Mario | 254/84 |
| 1,908,793 | 5/1933 | Saeder | 254/84 |
| 2,219,577 | 10/1940 | Neely et al. | 254/109 X |
| 3,159,110 | 12/1964 | Wylie | 104/246 |
| 3,734,465 | 5/1973 | Patchen et al. | 254/84 |
| 4,090,453 | 5/1978 | Ali et al. | 104/273 |

FOREIGN PATENT DOCUMENTS

| | | | |
|---|---|---|---|
| 0237843 | 12/1910 | Fed. Rep. of Germany | 104/273 |
| 1430978 | 3/1969 | Fed. Rep. of Germany | 104/120 |
| 25070 | 9/1931 | Netherlands | 254/84 |
| 0006208 | of 1910 | United Kingdom | 104/273 |

*Primary Examiner*—Robert B. Reeves
*Assistant Examiner*—Joseph D. Pape
*Attorney, Agent, or Firm*—Merchant, Gould, Smith, Edell, Welter & Schmidt

[57] ABSTRACT

The invention provides a lifting device for re-railing railroad vehicles comprising a guide rail which is adapted to be disposed substantially horizontally in use, having an outer surface including a toothed rack, a traveller mounted by rollers for guided movement along the rail, the traveller being adapted to support a lifting jack or the like in use, and a drive engaging the toothed rack for transversely moving the traveller.

1 Claim, 2 Drawing Sheets

RAIL GUIDED JACK FOR LIFTING DERAILED ROLLING STOCK

FIELD OF INVENTION

This invention relates to a lifting device which will in particular be suitable for re-railing rolling stock, locomotives etc.

DESCRIPTION OF PRIOR ART

Jack devices are available for lifting derailed rolling stock, locomotives, etc. but problems are encountered in moving units laterally into position above the rails during the re-railing process. It is accordingly an object of the present invention to provide a novel lifting device which will permit lateral movement of a lifted unit.

SUMMARY OF INVENTION

According to the invention such a lifting device comprises a guide rail which is adapted to be disposed substantially horizontally in use, a traveller mounted for movement on the rail, the traveller being adapted to support a lifting jack or the like in use, and drive means for moving the traveller along the guide.

Preferably the traveller will include rollers, wheels or the like which engage the guide and minimize friction. Where the guide is in the form of a rail section defining a head, base and interconnecting web, the rollers will preferably engage the upper surface of the base section or a member adjacent thereto, and preferably also under the head.

It is further envisaged that the guide rail will be mounted on transverse ground engaging supports. Such supports may be vertically extensible to enable the guide rail to be adjusted relative to the horizontal.

Further according to the invention the drive means for moving the traveller along the guide rail comprises a pair of pawl members pivotally mounted at their ends to an oscillator which is adapted in operation to cause to and fro movements of the pawls alternately, and a suitably toothed rack on or associated with the guide rail so that upon operation of the oscillator the pawls alternately engage the rack to cause movement of the traveller. In one arrangement the oscillator will be a centrally pivoted rocker which engages the pawls one to either side of the pivot so that the oscillating movement of the rocker causes the desired movement of the pawls. It is envisaged that the oscillator will be disposed above the guide rail and the pawls arranged one above the other with the upper most pawl being longer than the lower pawl.

BRIEF DESCRIPTION OF PREFERRED EMBODIMENT

Figure 1:
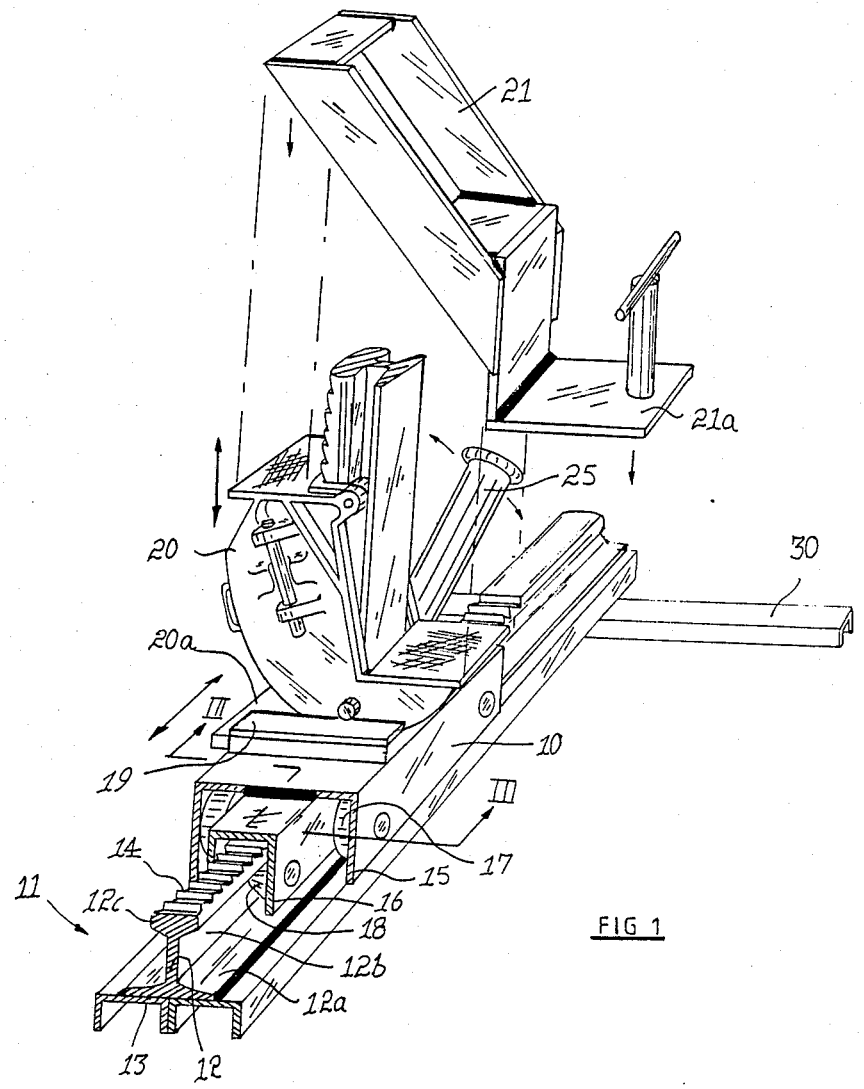
Figure 2:
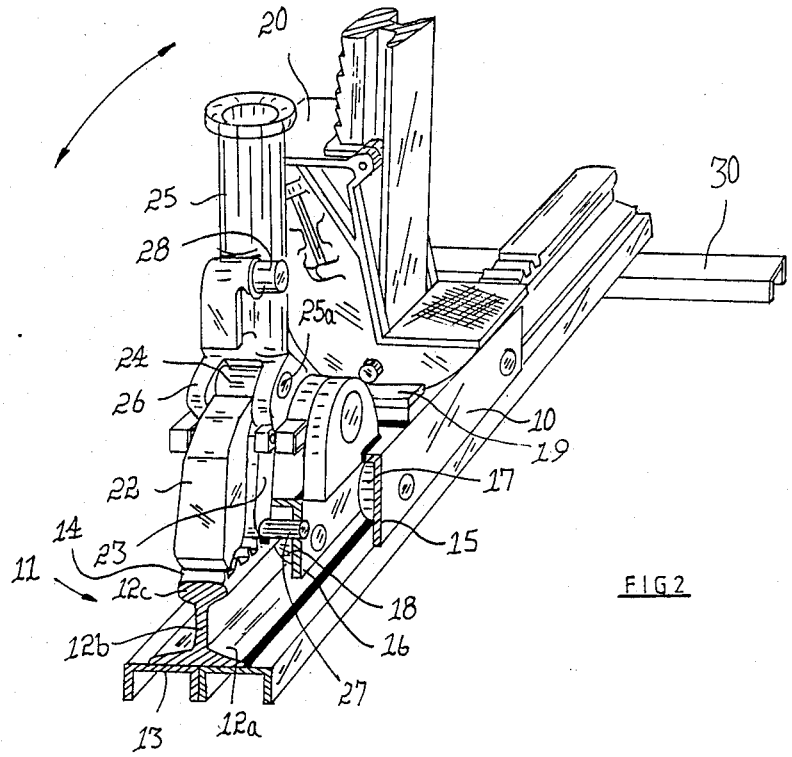
Figure 3:
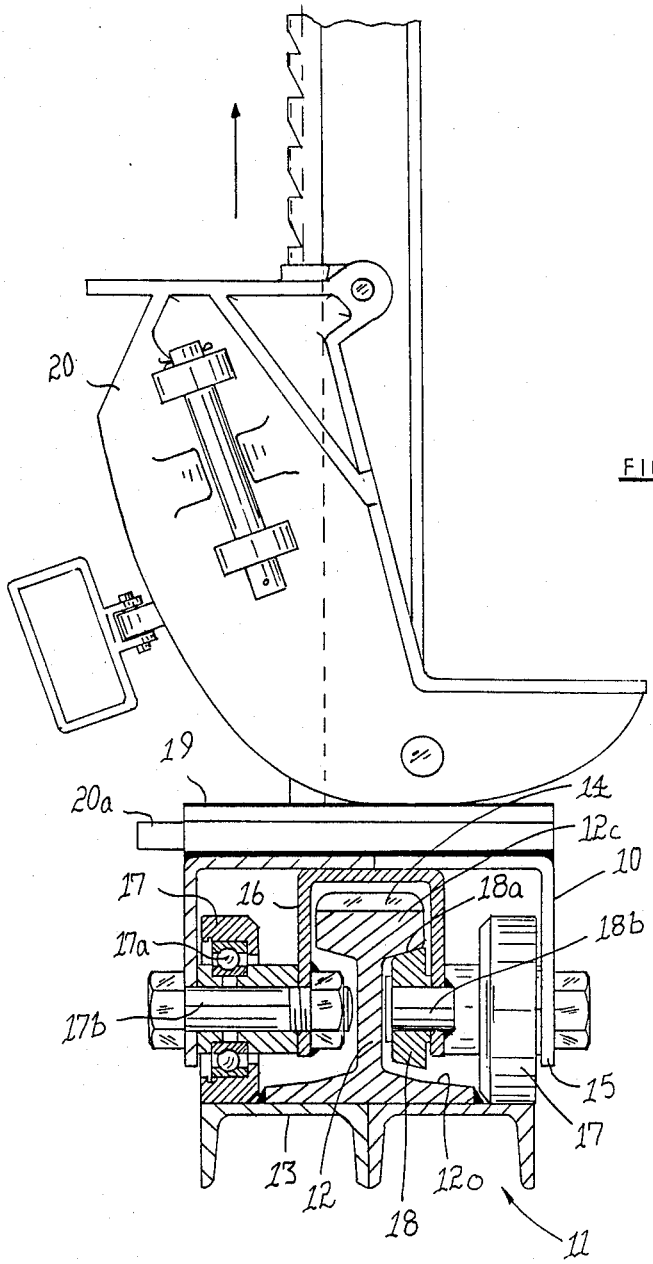
Figure 4:
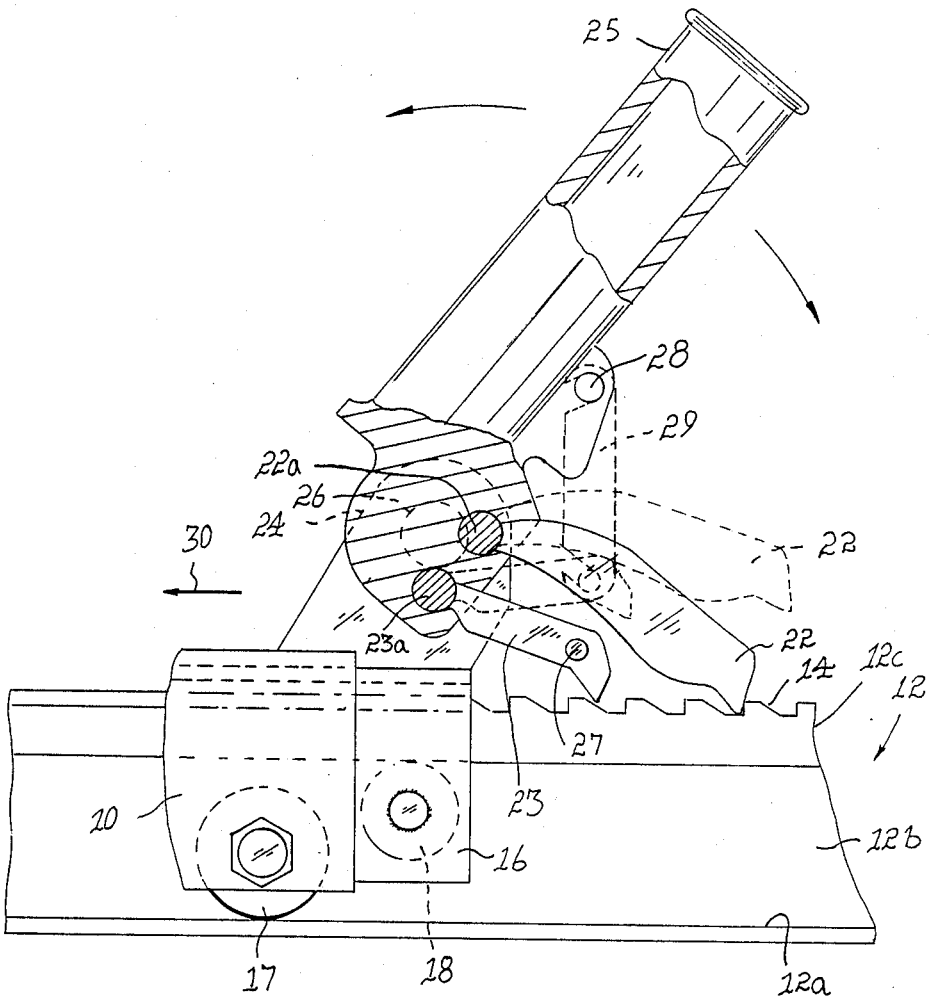

Other features of the invention will be apparent from the description hereinafter of a preferred embodiment with reference to the accompanying drawings wherein:

FIG. 1 is a perspective view of part of a lifting device in accordance with the invention, FIG. 2 is a perspective view of the lifting device in FIG. 1 viewed from the opposite side, FIG. 3 is a section through III—III in FIG. 1, and FIG. 4 is a partially sectioned elevation of the device in FIG. 1.

Referring to the drawings a lifting device which is particularly suitable for re-railing rolling stock, locomotives or the like comprises a guide rail 11 which will be mounted substantially horizontally in use on transverse ground engaging supports 30 and a traveller 10 which is movable on the guide rail 11 and which is adapted to mount a lifting jack shown at 20 which in use will act to lift the derailed unit. With the arrangement of the invention the lifted unit can be moved laterally relative to its rails, not shown, by moving the traveller 10 along the guide rail 11. Once the derailed unit is in position over its rails, the jack 20 will be lowered to re-rail the unit. The advantages of the arrangement of the invention will be apparent to persons skilled in the art.

In the arrangement illustrated the guide rail 11 comprises a rail section 12 having a base 12*a*, a head 12*c* and interconnecting webb 12*b*, the rail section 12*b* being secured in permanent fashion by means of welding or the like to a pair of adjacent downwardly directed channel sections 13.

The traveller 10 comprises an inner downwardly directed U-shaped channel section 16 which is mounted within the trough of a larger outer U-shaped downwardly directed channel section 15, with the inner channel section 16 serving to mount two or more inner rollers 18 on each of the legs of its U-shape, while the outer channel 15 acts to mount two or more outer rollers 17 on each of the legs of its U-shape. The outer rollers 17 serve a load bearing function and ride on the upper surface of the channel sections 13 adjacent the webb 12*a*, while the inner rollers 18 engage under the head 12*c* of the rail section 12 to prevent dislodgement of the traveller 10 from the guide rail. Preferably at least the outer load bearing rollers 17 will be mounted on suitable bearings 17*a*, FIG. 3. It will be noted in FIG. 3 that the load bearing rollers 17 are mounted in a removable fashion by means of a bolt 17*b* which passes through the legs of the channel 16 and the channel 15. The inner rollers 18 being subjected to little wear could be mounted in a semi-permanent fashion by means of a stub shaft 1 8*b* welded to the channel 16 as shown in FIG. 3. Preferably the contact surface of the roller 18 will be bevelled at 18*a* to mate with the bottom surface of the rail head 12*c*.

A further feature of the invention provides means to move the traveller 10 along the guide rail 11 and comprises a pair of pawl members 22 and 23 which are adapted to be moved in a to and fro fashion and adapted alternatly to engage a rack of teeth 14 defined on the upper surface of the head 12*c* of the rail 12. Reciprocating movement of the pawls 22 and 23 is caused by an oscillator 24 which is adapted to oscillate angularly and which engages the ends 22*a* and 23*a* of the pawls 22 and 23 respectively, the oscillator 24 being mounted for angular movement on an axial shaft 26. In use the angular oscillating movement of the oscillator 24 is caused by pivotally reciprocating a handle member 25 means of a suitable extension rod, not shown, the handle member 25 being secured to the oscillator 24 by means of a transverse pin 25*a* which passes through the oscillator 24. It will be noted in FIG. 4 that the pawls 22 and 23 terminate in integral transverse shaft formations 22*a* and 23*a* respectively and these formations engage in transverse spaced slots in the oscillator 24. Preferably such slots will be slightly closed to prevent dislodgement of the formations 22*a* and 23*a* therefrom. Transverse dislodgement of these formations from their mating slots will be prevented by lugs defined on the handle member 25 and which flank the oscillator 24.

With reference to FIG. 4 it will be appreciated that operation of the handle 25 will cause movement of the traveller 10 in the direction of the arrow 30. In order to move the traveller 10 in the opposite direction, the pawl 22 and 23 could simply be lifted manually, but the invention envisages that a link 29 which is adapted to extend between a pin element 28 on the handle 25 and a pin element 27 on the pawl 23 could be provided to hold the pauls in a disengaged position.

In the arrangement illustrated drive means operable by the handle 25 is provided on one side of the traveller 10 to urge the latter in one direction. If desirable a pair of such drive means could be provided one on each side of the traveller 10 to enable the traveller to be driven in both directions. With the latter arrangement the profile of the teeth will be suitably modified preferably to a square profile instead of the saw-tooth profile illustrated.

Doubtless other variations of the invention exist without departing from the principles set out in the consistory clauses. For example if necessary, a bracket member 21 could be provided to seat on the jack device 20 as shown, the bracket 21 defining a platform structure 21a adapted to extend laterally from the jack 20 and to engage the rolling stock unit which is to be re-railed.

We claim:

1. A lifting device comprising a guide rail which is adapted to be disposed substantially horizontally in use upon a support surface, a traveller mounted for movement on the rail, said traveller adapted to support a lifting jack, and a drive means for moving said traveller along said guide rail;

said traveller including an inner channel having a first aperture, an outer channel having a second like aperture aligned with said first aperture, axle means extending through said apertures of said inner and said outer channels, outer rollers being mounted on said axle means inside said outer channel and outside said inner channel, a stub shaft extending generally orthogonally from said inner channel toward said guide rail, and inner rollers being mounted on said stub shaft.

* * * * *